US012383953B2

(12) United States Patent
Lee et al.

(10) Patent No.: US 12,383,953 B2
(45) Date of Patent: Aug. 12, 2025

(54) CASTING MOLD DEVICE

(71) Applicants: HYUNDAI MOTOR COMPANY, Seoul (KR); KIA CORPORATION, Seoul (KR)

(72) Inventors: Chanul Lee, Ulsan (KR); Si Young Kim, Ulsan (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 18/747,052

(22) Filed: Jun. 18, 2024

(65) Prior Publication Data

US 2025/0091123 A1 Mar. 20, 2025

(30) Foreign Application Priority Data

Sep. 18, 2023 (KR) ..... 10-2023-0123694

(51) Int. Cl.
*B22D 17/22* (2006.01)
*B22D 17/24* (2006.01)

(52) U.S. Cl.
CPC ..... *B22D 17/2218* (2013.01); *B22D 17/2227* (2013.01); *B22D 17/24* (2013.01)

(58) Field of Classification Search
CPC ..... B22D 17/2218; B22D 17/2227; B22D 17/24; B22D 25/02
See application file for complete search history.

(56) References Cited

U.S. PATENT DOCUMENTS

2009/0250186 A1* 10/2009 Kwak ..... B22D 25/06 164/253

* cited by examiner

*Primary Examiner* — Kevin P Kerns
*Assistant Examiner* — Steven S Ha
(74) *Attorney, Agent, or Firm* — Lempia Summerfield Katz LLC

(57) ABSTRACT

A casting mold device includes a lower die and an upper die capable of being attached to or detached from the lower die and is configured to produce a cylinder head having spark plug mounting portions. In particular, the casting mold device includes: i) a plurality of core pin assemblies mounted in the upper die to form the spark plug mounting portions and having cooling air flow paths formed therein, ii) a cooling unit installed on the upper die and including cooling air inlet portions and cooling air outlet portions respectively connected to the cooling air flow paths of the core pin assemblies, and iii) a sealing unit coupled to the cooling unit and the upper die to seal portions between the core pin assemblies and the cooling unit.

14 Claims, 13 Drawing Sheets

CASTING MOLD DEVICE

CROSS-REFERENCE TO RELATED APPLICATION

This application claims priority to and the benefit of Korean Patent Application No. 10-2023-0123694, filed in the Korean Intellectual Property Office on Sep. 18, 2023, the entire contents of which are incorporated herein by reference.

BACKGROUND

(a) Field

Embodiments of the present disclosure relate to a casting mold device, and more particularly, to a casting mold device capable of producing an engine component for a vehicle.

(b) Description of the Related Art

In general, a casting process method refers to a manufacturing process for producing a product with a predetermined shape by injecting molten metal into a casting mold and changing a phase of the molten metal into a solid state (e.g., solidifying the molten metal). For example, components for a vehicle engine, such as a cylinder head, may be manufactured by a high-pressure or low-pressure casting process using molten aluminum.

Examples of the casting process may include a low-pressure casting process that pushes molten metal upward to a portion between an upper die and a lower die along a stalk by using low-pressure compressed air from a heat retention furnace disposed below a casting mold and then solidifies the molten metal.

The casting mold device, which produces a cylinder head by using the low-pressure casting process, is equipped with a core pin provided in the upper die to form a spark plug mounting hole in the cylinder head. The core pin is mounted in an upper forming part of the upper die.

In addition, the casting mold device is equipped with a cooling unit configured to cool the core pin by allowing a cooling medium to flow around the core pin during a casting process.

In this case, the cooling unit may cool the core pin using the cooling medium as a coolant and allow the coolant to flow around the core pin.

However, in case that the coolant is used, the core pin may be overcooled, which may degrade quality of a cylinder head product. In addition, the coolant may leak from the core pin, which may cause a safety accident during the casting process.

Therefore, a cooling unit, which uses cooling air as the cooling medium and allows the cooling air to flow around the core pin, is applied.

However, in order to simplify the structure, the casting mold device, which adopts the air-cooled cooling unit, does not have a separate discharge structure configured to discharge cooling air, and the casting mold device discharges the cooling air through a gap between the cooling unit and the core pin.

Therefore, because the cooling air is discharged through the gap between the cooling unit and the core pin, exhaust noise may occur. This exhaust noise may degrade a working environment of an operator, such as causing hearing impairment of the operator.

Furthermore, the core pin, to which the air-cooled cooling unit is applied, is configured as an integrated type. Because the core pin is in contact with molten metal over a long period of time, the core pin is damaged even though the core pin is cooled, and for this reason, an excessive amount of costs may be required to replace the core pin.

The above information disclosed in this background section is provided only to enhance understanding of the background of the present disclosure and therefore it may contain information that does not form the prior art that is already known to a person of ordinary skill in the art.

SUMMARY

The present disclosure provides a casting mold device capable of minimizing exhaust noise of cooling air generated when a core pin is cooled by cooling air.

An embodiment of the disclosed present disclosure provides a casting mold device configured to produce a cylinder head having spark plug mounting portions. The casting mold device includes: a lower die and an upper die capable of being attached to or detached from the lower die. The casting mold device further includes: i) a plurality of core pin assemblies mounted in the upper die to form the spark plug mounting portions and having cooling air flow paths formed therein, ii) a cooling unit installed on the upper die and including cooling air inlet portions and cooling air outlet portions respectively connected to the cooling air flow paths of the core pin assemblies, and iii) a sealing unit coupled to the cooling unit and the upper die to seal portions between the core pin assemblies and the cooling unit.

In another embodiment, the cooling unit may include a cooling air discharge module connected to the cooling air outlet portions.

In an embodiment of the present disclosure, the sealing unit may include: a sealing plate disposed between the core pin assemblies and the cooling unit; and a plurality of sealing fastening members configured to fasten the cooling unit and the sealing plate and fasten the sealing plate and the upper die.

Another embodiment of the disclosed present disclosure provides a casting mold device that includes a lower die and an upper die capable of being attached to or detached from the lower die. The casting mold device further includes: a plurality of core pin assemblies mounted in the upper die and including a plurality of separating pins capable of being coupled to or separated from one another. In particular, the plurality of core pin assemblies incudes cooling air flow paths formed in the separating pins coupled to one another. The casting mold device further includes: a cooling unit installed on the upper die and connected to the cooling air flow paths so as to inject and discharge cooling air; and a sealing unit coupled to the cooling unit and the upper die to seal portions between the core pin assemblies and the cooling unit.

In another embodiment of the present disclosure, the core pin assemblies may be respectively mounted in pin insertion holes formed in the upper die in an upward/downward direction to form spark plug mounting portions of a cylinder head.

In other embodiment of the present disclosure, the separating pins may each include: a cylindrical plug casing fitted with a pin insertion hole formed in the upper die in an upward/downward direction. In particular, the cylindrical plug casing is opened at upper and lower ends thereof. The separating pins may each include: a plug pin fitted with the plug casing, coupled to a lower portion of the cylindrical plug casing, opened at an upper end thereof, and closed at a lower end thereof; and a plug bushing fitted with the plug casing so as to be positioned above the plug pin, coupled to an upper portion of the cylindrical plug casing, and having a cylindrical shape opened at upper and lower ends thereof.

In an embodiment of the present disclosure, the cylindrical plug casing may include a casing outer flange formed on an outer periphery of an upper end thereof, and a casing inner flange formed on an inner periphery of a lower end thereof.

In an embodiment of the present disclosure, the plug bushing may include a bushing outer flange formed on an outer periphery of an upper end thereof.

In an embodiment of the present disclosure, the casing outer flange and the bushing outer flange may be fastened by a plurality of bolts.

In an embodiment of the present disclosure, the casing inner flange may be coupled to a pin outer flange formed at an upper end of the plug pin by means of a locking projection.

In another embodiment of the present disclosure, the cooling unit may include: a plurality of head blocks disposed at positions corresponding to the core pin assemblies and respectively having cooling air inlet portions and cooling air outlet portions; cooling pipes connected to the cooling air inlet portions of the head blocks and disposed in the cooling air flow paths; and a cooling air discharge module connected to the cooling air outlet portions of the head blocks.

In an embodiment of the present disclosure, the cooling unit may include cooling air inlet pipes each connected to one side of each of the cooling air inlet portions of the head blocks.

In an embodiment of the present disclosure, the cooling pipes may each be connected to the other side of each of the cooling air inlet portions by tapping.

In an embodiment of the present disclosure, the cooling air discharge module may include: a connection pipe connected to the cooling air outlet portions of the head blocks; an air discharge housing connected to the connection pipe; and an air discharge pipe connected to the air discharge housing.

In an embodiment of the present disclosure, the air discharge pipe may extend toward one side edge of an upper holder coupled to the upper die.

In an embodiment of the present disclosure, the cooling air flow paths may include a flow path groove formed in the plug pin, and a hollow portion of the plug bushing connected to the flow path groove.

In an embodiment of the present disclosure, the cooling unit may include: a plurality of head blocks disposed at positions respectively corresponding to the core pin assemblies and respectively having cooling air inlet portions and cooling air outlet portions; and cooling pipes connected to the cooling air inlet portions of the head blocks and disposed in the plug bushing and the plug pin.

In an embodiment of the present disclosure, at least one cooling air flow path of the cooling air flow paths may include a cooling air discharge flow path formed between an outer periphery of the cooling pipe, an inner periphery of the plug bushing, and an inner periphery of the plug pin. The cooling air discharge flow path is connected to the cooling pipe and the cooling air outlet portion.

In an embodiment of the present disclosure, the sealing unit may include: a sealing plate disposed between the core pin assemblies and the head block; and a plurality of sealing fastening members configured to fasten the head blocks and the sealing plate and fasten the sealing plate and the upper die.

In an embodiment of the present disclosure, the sealing fastening members may respectively include sealing fastening bolts.

According to the casting mold device according to the embodiment of the present disclosure, it is possible to minimize exhaust noise of the cooling air used to cool the core pin assemblies, thereby improving the working environment of the operator while preventing hearing impairment of the operator.

Other effects, which may be obtained or expected by the embodiments of the present disclosure, should be directly or implicitly disclosed in the detailed description on the embodiments of the present disclosure. In other words, various effects expected according to the embodiments of the present disclosure are disclosed in the detailed description below.

BRIEF DESCRIPTION OF THE DRAWINGS

Because the drawings are provided for reference to describe embodiments of the present disclosure, the technical spirit of the present disclosure should not be construed as being limited to the accompanying drawings.

Figure 1:
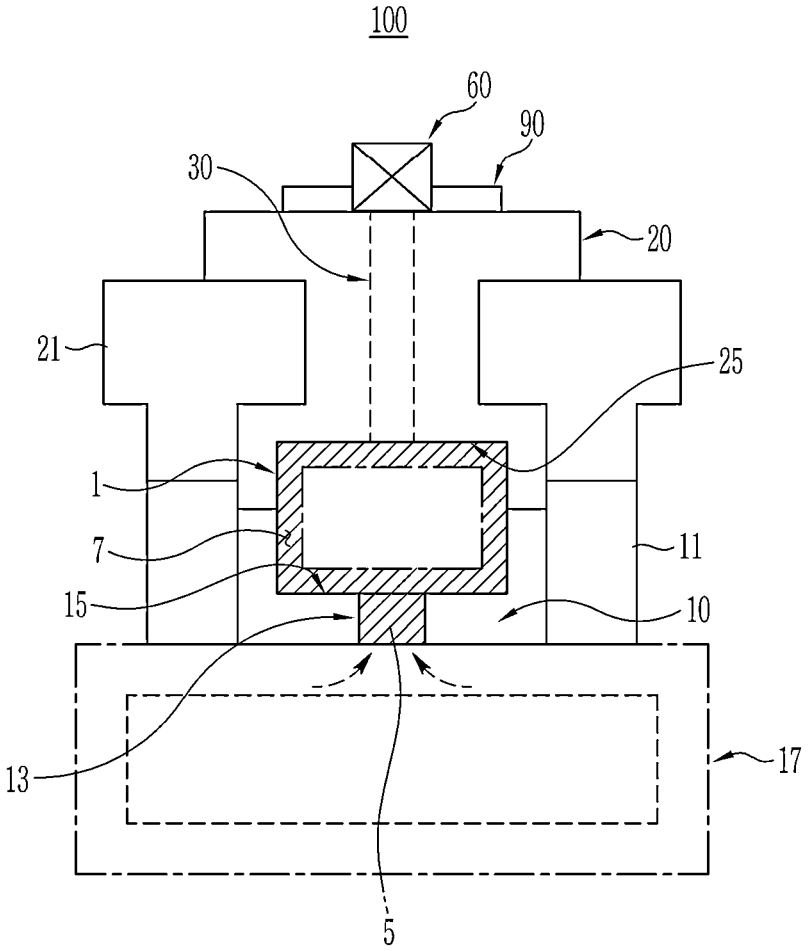
FIG. 1 is a block configuration view schematically illustrating a casting mold device according to an embodiment of the present disclosure.

It should be understood that the accompanying drawings are not necessarily to scale, but provide a somewhat simplified representation of various features that exemplify the basic principles of the present disclosure. For example, specific design features of the present disclosure, including particular dimensions, directions, positions, and shapes, should be partially determined by the particularly intended application and use environment.

DETAILED DESCRIPTION

Hereinafter, embodiments of the present disclosure are described in detail with reference to the accompanying drawings so that those with ordinary skill in the art to which the present disclosure pertains may easily carry out the embodiments. However, the present disclosure may be implemented in various different ways and is not limited to the embodiments described herein.

A part irrelevant to the description has been omitted to clearly describe the present disclosure, and the same or similar constituent elements are designated by the same reference numerals throughout the specification.

The size and thickness of each component illustrated in the drawings are arbitrarily shown for ease of description, but the present disclosure is not necessarily limited thereto. In order to clearly describe several portions and regions, thicknesses thereof are enlarged.

In addition, the term "unit." "part," "member", or the like, which is described in the specification, means a unit of a comprehensive configuration that performs at least one function or operation.

When a component, device, element, or the like of the present disclosure is described as having a purpose or performing an operation, function, or the like, the component, device, or element should be considered herein as being "configured to" meet that purpose or to perform that operation or function.

The terms used in the present specification are for explaining the exemplary embodiments, not for limiting the present disclosure. The singular expressions used herein are intended to include the plural expressions unless the context clearly dictates otherwise.

It is to be understood that the term "comprise (include)" and/or "comprising (including)" used in the present specification means that the features, the integers, the steps, the operations, the constituent elements, and/or component are present, but the presence or addition of one or more of other features, integers, steps, operations, constituent elements, components, and/or groups thereof is not excluded.

The term 'coupled' used in the present specification indicates a physical relationship between two components that are connected directly to each other or connected indirectly through one or more intermediate components.

Hereinafter, embodiments of the present disclosure are described in detail with reference to the accompanying drawings.

FIG. 1 is a block configuration view schematically illustrating a casting mold device according to an embodiment of the present disclosure.

With reference to FIG. 1, a casting mold device 100 according to an embodiment of the present disclosure may be applied to a process of manufacturing a casting product with a desired shape by injecting molten metal, which is made of aluminum, magnesium, or an alloy thereof, into a die.

According to an embodiment of the present disclosure, the casting mold device 100 may be applied to a process of manufacturing components for a vehicle engine by using a casting process.

Furthermore, the casting mold device 100 according to the embodiment of the present disclosure may be applied to a process of manufacturing a cylinder head for a vehicle engine by using a low-pressure casting process.

Figure 2:
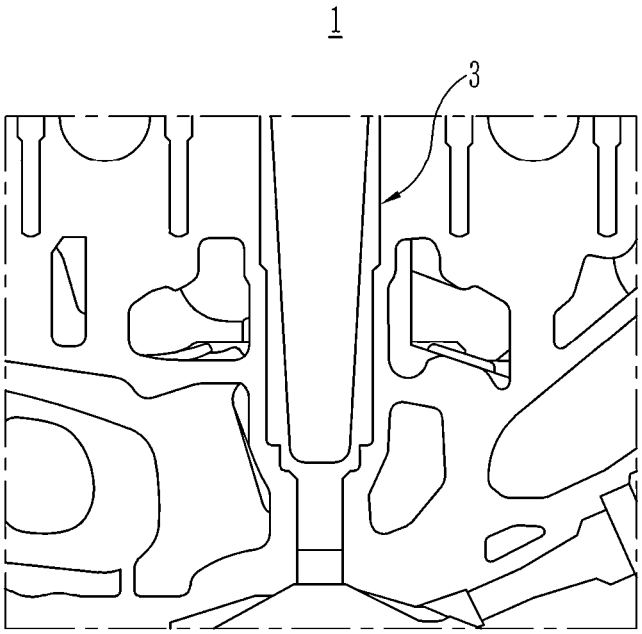
FIG. 2 is a view schematically illustrating an example of a cylinder head produced by the casting mold device according to the embodiment of the present disclosure.

In this case, as illustrated in FIG. 2, a cylinder head 1, which is produced by the casting mold device 100, includes spark plug mounting portions 3 provided in the form of holes in which a plurality of spark plugs (not illustrated) is mounted.

Therefore, the casting mold device 100 according to the embodiment of the present disclosure is configured to produce the cylinder head 1 having the spark plug mounting portions 3.

In the present specification, reference directions for explaining the following components may be set as a forward/rearward direction, a leftward/rightward direction, and an upward/downward direction.

Further, in the present specification, the terms 'upper end portion,' 'upper portion', 'upper end' or 'upper surface' of a component means an end portion, a portion, an end, or a surface of the component which is disposed at a relative upper side, and the terms 'lower end portion,' 'lower portion', 'lower end', or 'lower surface' of a component means an end portion, a portion, an end, or a surface of the component which is disposed at a relatively lower side.

In addition, in the present specification, an end (e.g., one end or the other end) of a component means an end of the component in any one direction, and an end portion (e.g., one end portion or the other end portion) of a component means a predetermined portion of the component that includes the end of the component.

With reference to FIGS. 1 and 2, the casting mold device 100 according to the embodiment of the present disclosure basically includes a lower die 10 and an upper die 20.

The lower die 10 is disposed on a floor of a process workplace and mounted on a lower holder 11. The lower die 10 includes a molten metal injection part 13 and a lower forming part 15.

The molten metal injection part 13 is provided below the lower forming part 15. The molten metal injection part 13 is connected to a heat retention furnace 17 disposed below the lower holder 11.

The heat retention furnace 17 may accommodate molten metal 5, push the molten metal 5 upward by using low-pressure compressed air, and inject the molten metal 5 into the molten metal injection part 13. A method of injecting the molten metal 5 into the molten metal injection part 13 with low pressure may be defined as a low-pressure casting process.

The lower forming part 15 is provided at an upper side of the lower die and has a shape corresponding to a lower shape of the cylinder head 1. The lower forming part 15 may be connected to the molten metal injection part 13.

Further, the upper die 20 is installed at a position corresponding to the lower die 10 and configured to be movable in the upward/downward direction. The upper die 20 is mounted on an upper holder 21 and configured to be attached to or detached from the lower die 10.

The upper die 20 may be reciprocated in the upward/downward direction by a drive device, such as a drive slider, known to those having ordinary skill in the art.

The upper die 20 includes an upper forming part 25. The upper forming part 25 is provided at a lower side of the upper die 20 and has a shape corresponding to an upper shape of the cylinder head 1.

Therefore, according to the casting mold device 100 according to the embodiment of the present disclosure, when the lower die 10 and the upper die are attached to each other, the lower forming part 15 and the upper forming part 25 may define a cavity 7 with a preset shape and volume.

Therefore, in the casting mold device 100 according to the embodiment of the present disclosure, when the molten metal 5 is injected into the cavity 7 through the molten metal injection part 13, the cylinder head 1 with a preset shape may be produced by the lower forming part 15 and the upper forming part 25.

According to the embodiment of the present disclosure, the casting mold device 100 includes a pin-type core structure configured to form the spark plug mounting portions 3 in the form of holes in the cylinder head 1. In another embodiment, the casting mold device 100 includes a cooling structure configured to cool the pin-type core structure.

In this case, the cooling structure is configured to cool the pin-type core structure by using cooling air. The cooling structure may cool the pin-type core structure by allowing the cooling air to flow to the pin-type core structure.

The casting mold device 100 according to the embodiment of the present disclosure minimizes exhaust noise of the cooling air generated when the pin-type core structure is cooled by the cooling air.

Figure 3:
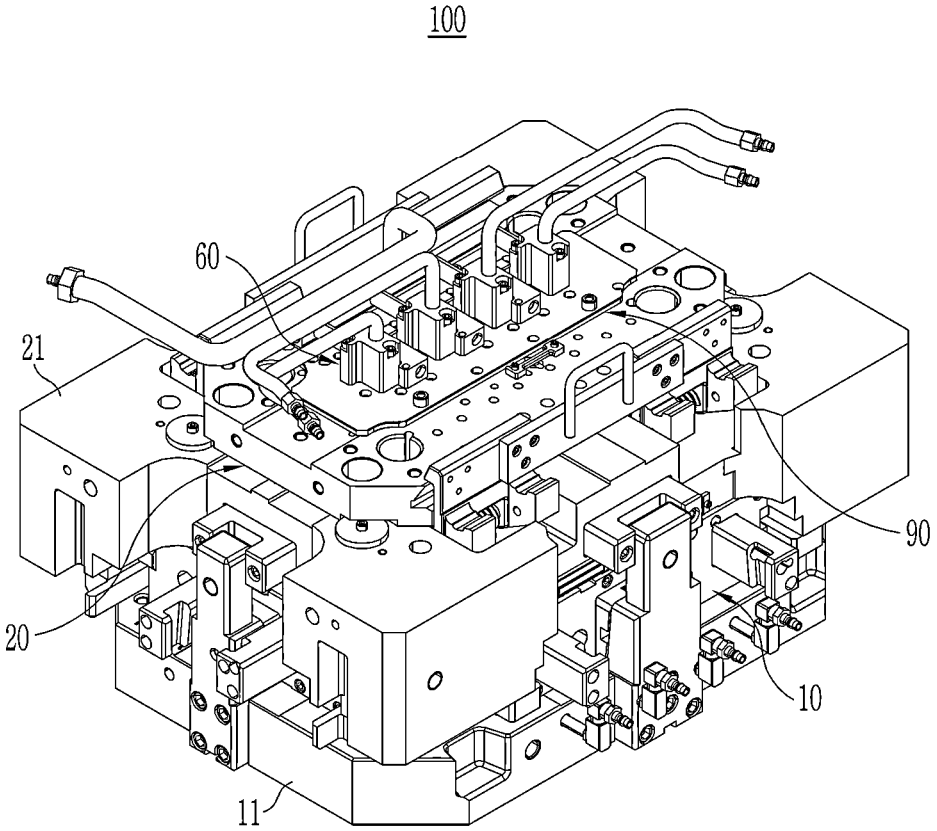
FIG. 3 is a perspective view illustrating the casting mold device according to an embodiment of the present disclosure.
Figure 4:
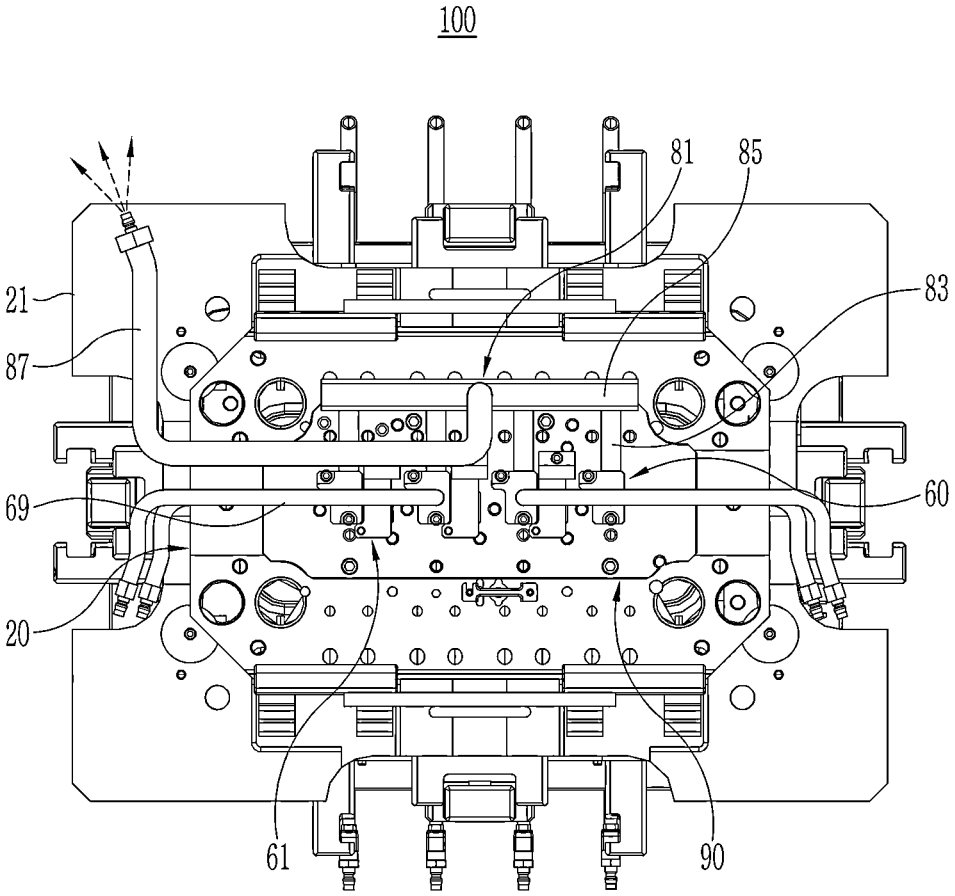
FIG. 4 is a top plan view illustrating the casting mold device according to the embodiment of the present disclosure.
Figure 5:
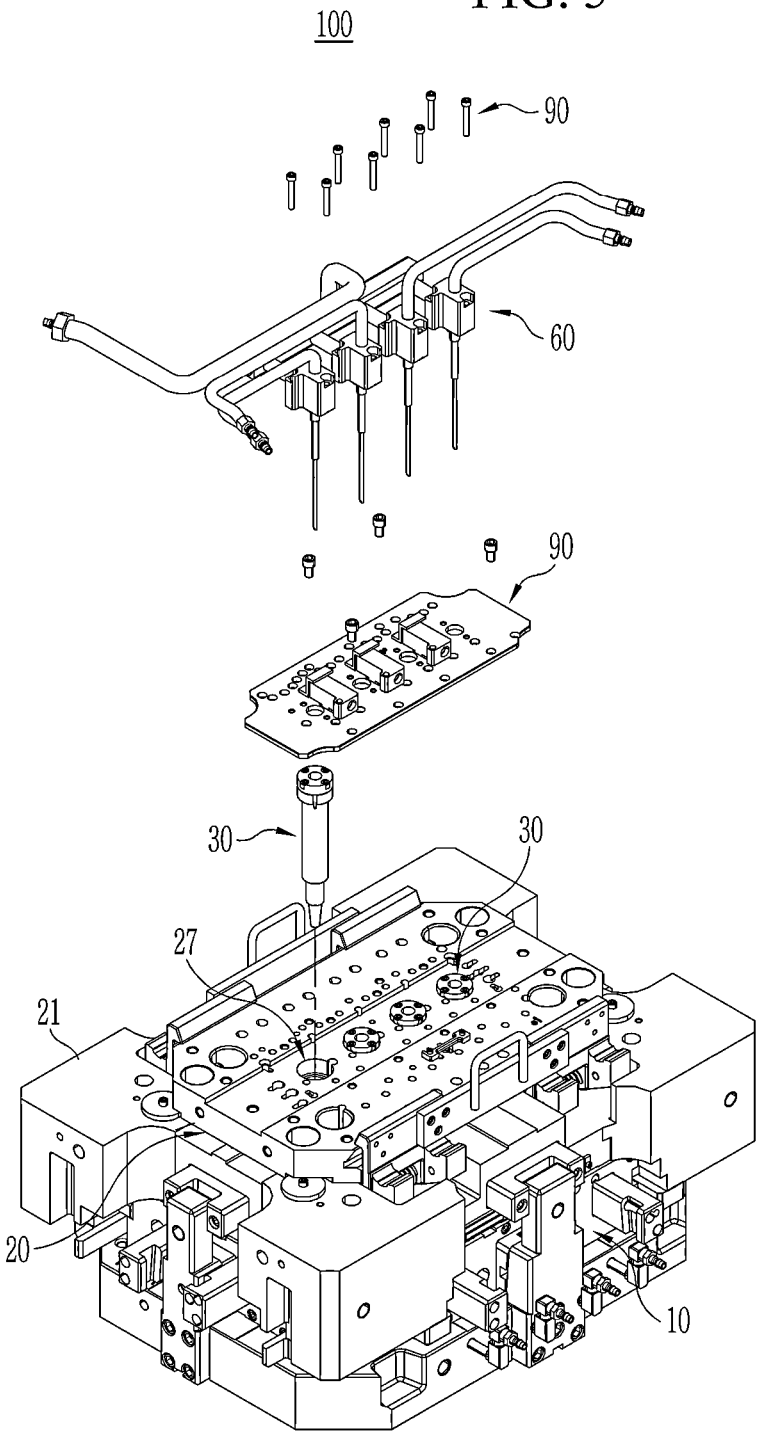
FIG. 5 is an exploded perspective view illustrating the casting mold device according to the embodiment of the present disclosure.

FIG. 3 is a perspective view illustrating the casting mold device according to the embodiment of the present disclosure, FIG. 4 is a top plan view illustrating the casting mold device according to the embodiment of the present disclosure, and FIG. 5 is an exploded perspective view illustrating the casting mold device according to the embodiment of the present disclosure.

With reference to FIGS. 1-5, the casting mold device 100 according to the embodiment of the present disclosure includes a plurality of core pin assemblies 30, a cooling unit 60, and a sealing unit 90.

In the embodiment of the present disclosure, the core pin assemblies are configured to form the spark plug mounting portions 3 in the cylinder head 1. The core pin assemblies 30 are mounted in the upper die 20.

The core pin assemblies 30 are disposed in the upper die 20 and spaced apart from one another at preset intervals in the forward/rearward direction. The core pin assemblies 30 may be respectively mounted in pin insertion holes 27 formed in the upper die 20 in the upward/downward direction. In this case, the pin insertion hole 27 penetrates the upper forming part 25 in the upward/downward direction from above the upper die 20.

Figure 6:
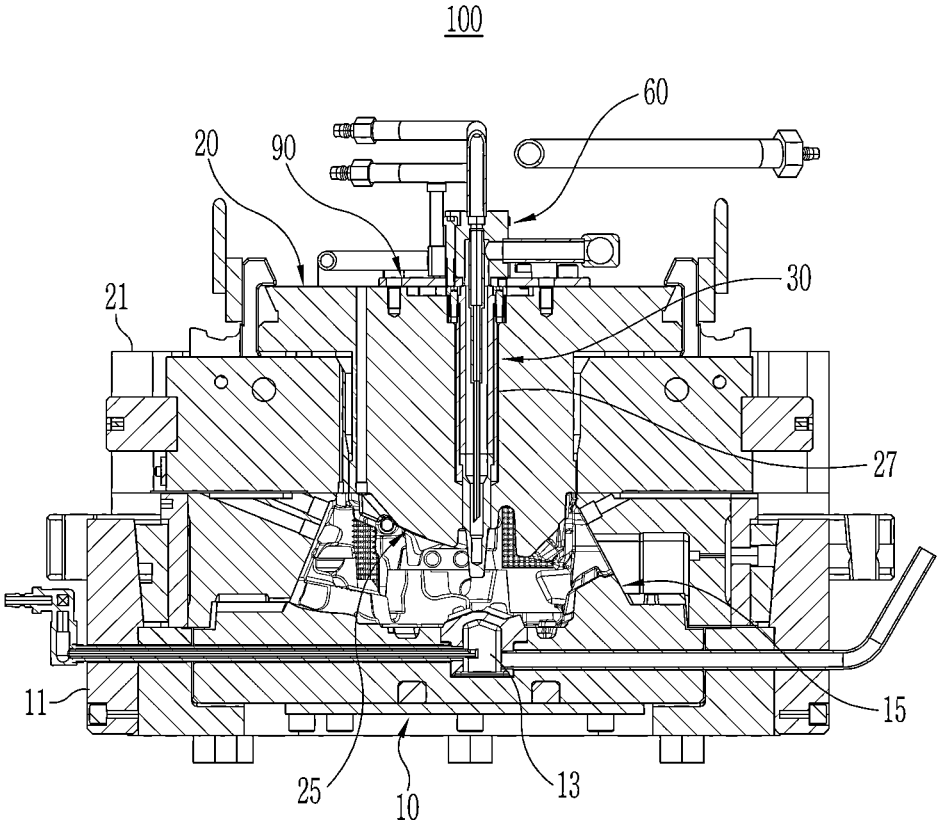
FIG. 6 is a cross-sectional view illustrating the casting mold device according to the embodiment of the present disclosure.
Figure 7:
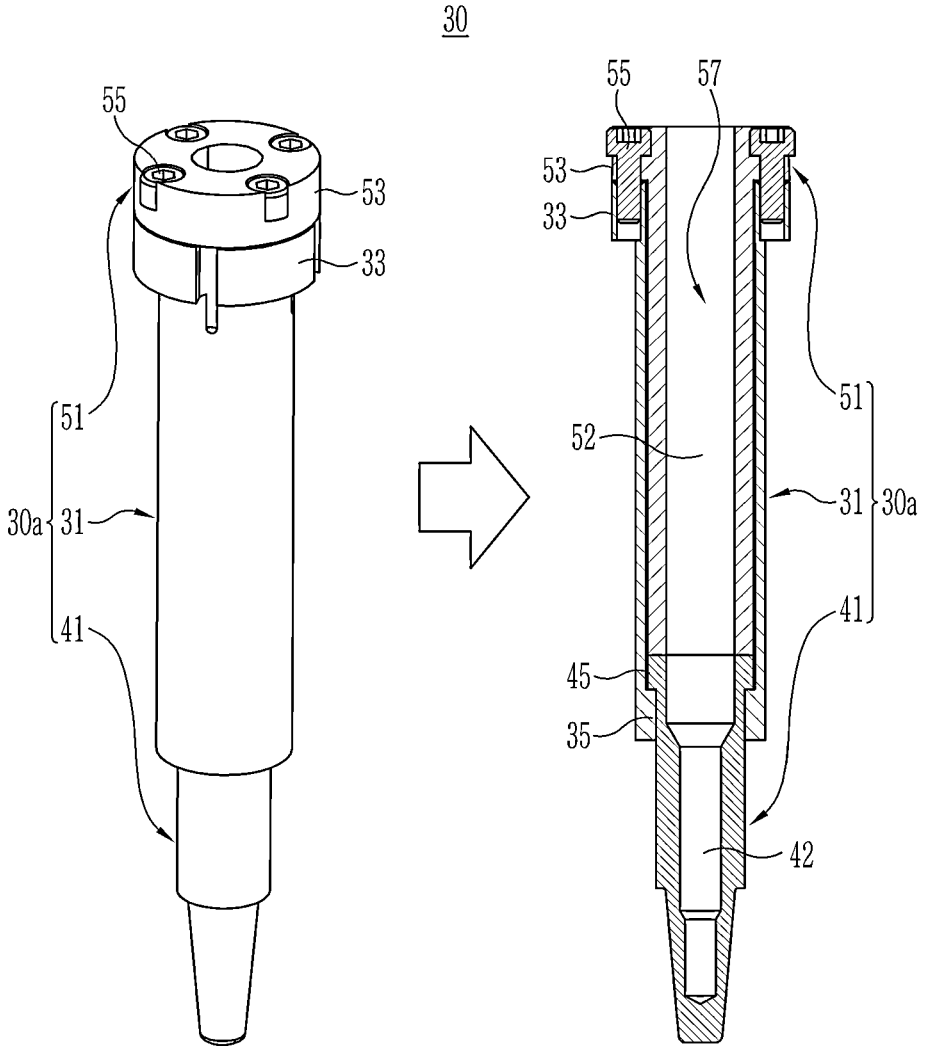
FIG. 7 is a perspective view and a cross-sectional view illustrating a core pin assembly applied to the casting mold device according to an embodiment of the present disclosure.
Figure 8:
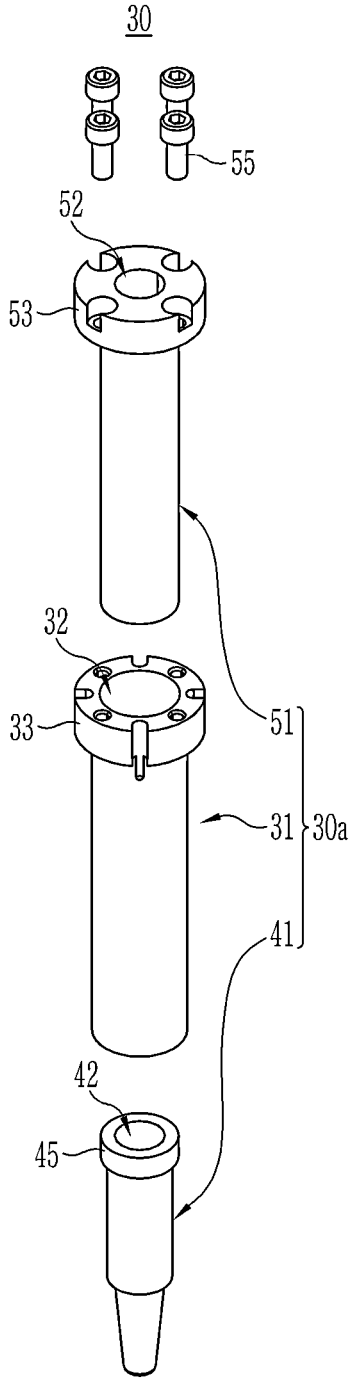
FIG. 8 is an exploded perspective view illustrating the core pin assembly applied to the casting mold device according to an embodiment of the present disclosure.

FIG. 6 is a cross-sectional view illustrating the casting mold device according to the embodiment of the present disclosure, FIG. 7 is a perspective view and a cross-sectional view illustrating the core pin assembly applied to the casting mold device according to the embodiment of the present disclosure, and FIG. 8 is an exploded perspective view illustrating the core pin assembly applied to the casting mold device according to the embodiment of the present disclosure.

With reference to FIGS. 5-8, the core pin assemblies 30 according to the embodiment of the present disclosure include a plurality of separating pins 30*a* capable of being coupled to and separated from one another.

The separating pins 30*a* each include a plug casing 31, a plug pin 41, and a plug bushing 51.

In the embodiment of the present disclosure, the plug casing 31 is fitted with the pin insertion hole 27 of the upper die 20 in the upward/downward direction. The plug casing 31 may have a cylindrical shape having a hollow portion 32 opened at upper and lower ends thereof.

The plug casing 31 may include a casing outer flange 33 and a casing inner flange 35.

The casing outer flange 33 is formed on an outer periphery of an upper end of the plug casing 31. The casing outer flange 33 may support an upper surface of the upper die 20. The casing inner flange 35 is formed on an inner periphery of a lower end of the plug casing 31.

In an embodiment of the present disclosure, the plug pin 41 is fitted with the hollow portion 32 of the plug casing 31 in the upward/downward direction and coupled to a lower portion of the plug casing 31. Further, the plug pin 41 protrudes downward from the pin insertion hole 27.

The plug pin 41 includes a flow path groove 42 opened at an upper end thereof and closed at a lower end thereof. In another embodiment, the plug pin 41 includes a pin outer flange 45 formed on an outer periphery of an upper end of the plug pin 41.

In this case, the pin outer flange 45 of the plug pin 41 may be coupled to the casing inner flange 35 of the plug casing 31 by a locking projection.

Therefore, the plug pin 41 is coupled to the casing inner flange 35 by means of the pin outer flange 45 in the hollow portion 32 of the plug casing 31, such that the plug pin 41 may protrude downward from the pin insertion hole 27 in a state in which the plug pin 41 is coupled to the lower end of the plug casing 31.

In an embodiment of the present disclosure, the plug bushing 51 may be provided in the hollow portion 32 of the plug casing 31 and positioned above the plug pin 41.

The plug bushing 51 is fitted with the hollow portion 32 of the plug casing 31 in the upward/downward direction and coupled to the upper end of the plug casing 31. The plug bushing 51 may have a cylindrical shape having a hollow portion 52 opened at upper and lower ends thereof. In this case, a lower end of the plug bushing 51 is in contact with the upper end of the plug pin 41.

The plug bushing 51 includes a bushing outer flange 53 formed on an outer periphery of the upper end of the plug bushing 51. The bushing outer flange 53 may support an upper surface of the casing outer flange 33 of the plug casing 31.

The bushing outer flange 53 and the casing outer flange 33 are fastened in the upward/downward direction by a plurality of bolts 55. Further, the plug pin 41 may be coupled to the casing inner flange 35 of the plug casing 31 by means of the pin outer flange 45 and a locking projection and fixed by the plug bushing 51.

Therefore, the plug casing 31, the plug pin 41, and the plug bushing 51 may be mounted in the pin insertion hole 27 of the upper die 20 in the state in which the plug casing 31, the plug pin 41, and the plug bushing 51 are coupled to one another. Further, the plug casing 31, the plug pin 41, and the plug bushing 51, which are coupled to one another, may be separated from one another, in a state in which the plug casing 31, the plug pin 41, and the plug bushing 51 are withdrawn from the pin insertion hole 27.

Furthermore, the core pin assemblies 30, in which the plug casing 31, the plug pin 41, and the plug bushing 51 are coupled to one another, each include therein a cooling air flow path 57 formed in the upward/downward direction.

The cooling air flow path 57 may be defined by the flow path groove 42 of the plug pin 41 and the hollow portion 52 of the plug bushing 51 that are connected in the upward/downward direction in the hollow portion 32 of the plug casing 31.

With reference to FIGS. 3-6, in the embodiment of the present disclosure, the cooling unit 60 is configured to cool the core pin assemblies 30 by using the cooling air by allowing the cooling air through the cooling air flow paths 57 of the core pin assemblies 30.

The cooling unit 60 is installed on the upper die 20, connected to the cooling air flow paths 57 of the core pin assemblies 30, and configured to inject and discharge the cooling air.

Figure 9:
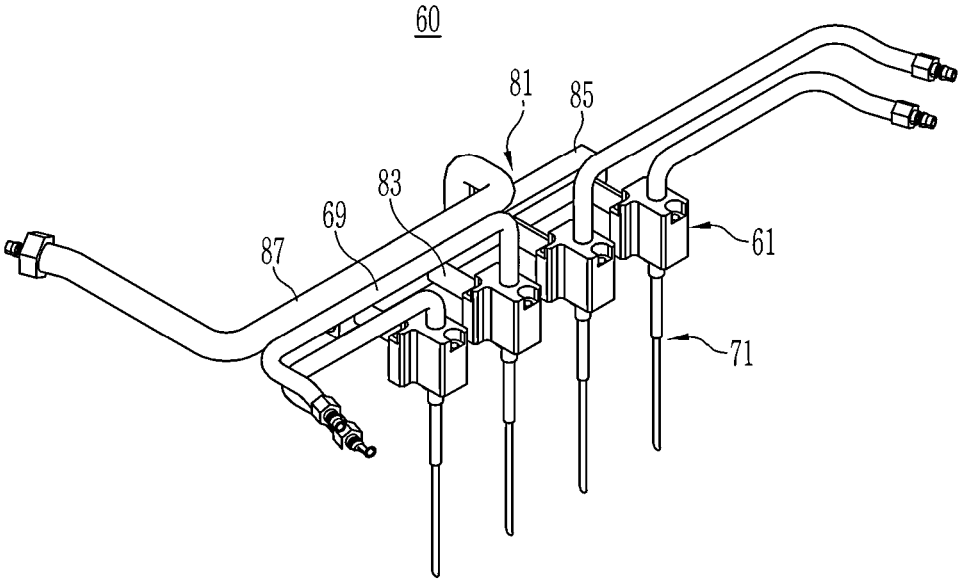
FIG. 9 is a perspective view illustrating a cooling unit applied to the casting mold device according to an embodiment of the present disclosure.
Figure 10:
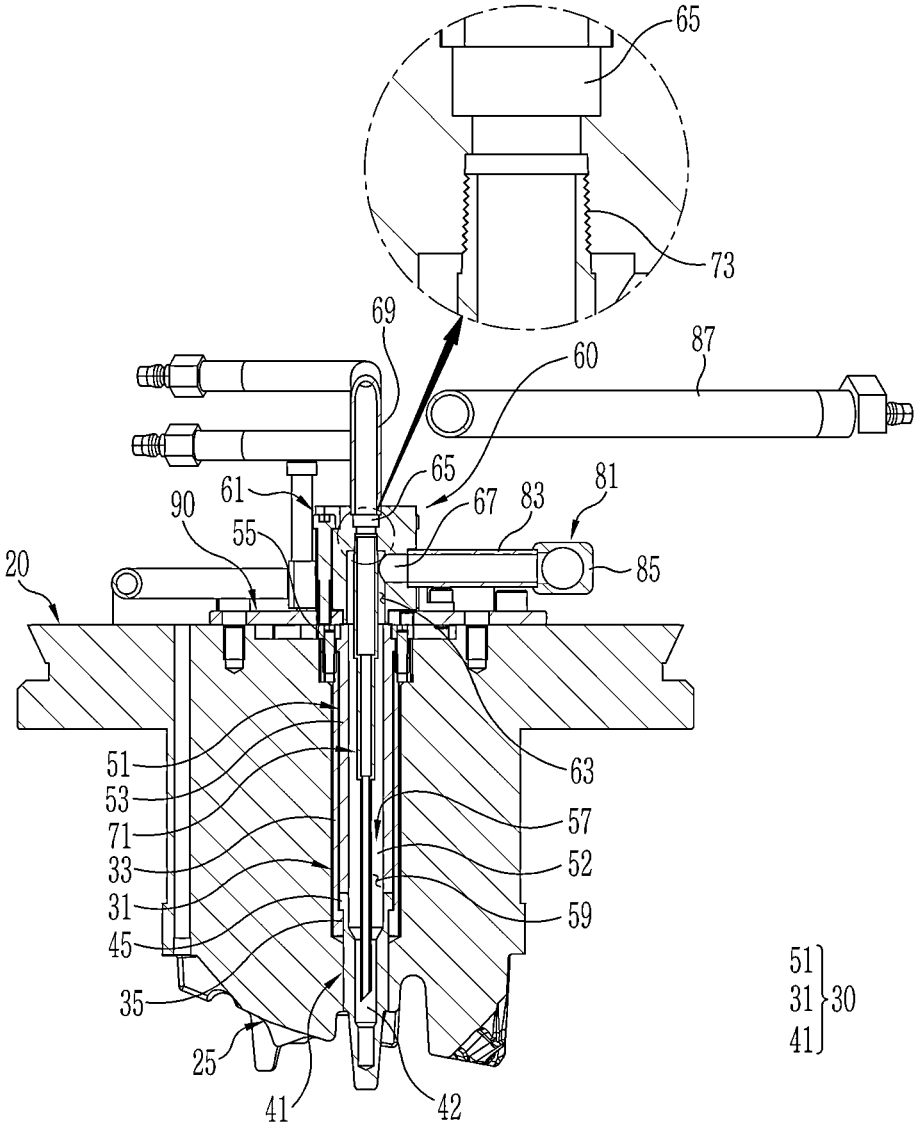
FIG. 10 is a cross-sectional view illustrating the cooling unit applied to the casting mold device according to the embodiment of the present disclosure.

FIG. 9 is a perspective view illustrating the cooling unit applied to the casting mold device according to the embodiment of the present disclosure, and FIG. 10 is a cross-sectional view illustrating the cooling unit applied to the casting mold device according to the embodiment of the present disclosure.

With reference to FIGS. 9 and 10, the cooling unit 60 according to the embodiment of the present disclosure includes a plurality of head blocks 61, cooling pipes 71, and a cooling air discharge module 81.

In an embodiment of the present disclosure, the head blocks 61 are each provided in the form of a block and disposed at positions on the upper die respectively corresponding to the core pin assemblies 30.

The head blocks 61 each include a path connection portion 63, a cooling air inlet portion 65, and a cooling air outlet portion 67.

The path connection portions 63 are connected to the cooling air flow paths 57 of the core pin assemblies 30. The path connection portion 63 is formed in a groove shape in a lower portion of each of the head blocks 61. Further, the path connection portion 63 is connected to the cooling air inlet portion 65 and the cooling air outlet portion 67 to be described below.

The cooling air inlet portion 65 is configured to introduce the cooling air into the cooling air flow path 57. The cooling air inlet portion 65 is provided in the form of a hole formed through an upper portion of each of the head blocks 61 in the upward/downward direction, and the cooling air inlet portion 65 is connected to the path connection portion 63.

Furthermore, a cooling air inlet pipe 69 is connected to one side (upper portion based on the drawings) of the cooling air inlet portion 65. The cooling air inlet pipe 69 may be connected to a cooling air supply part (not illustrated).

Further, the cooling air outlet portion 67 is configured to discharge the cooling air to the outside from the cooling air flow path 57. The cooling air outlet portion 67 is provided in the form of a hole formed through an approximately middle portion of each of the head blocks 61 in the leftward/rightward direction, and the cooling air outlet portion 67 is connected to the path connection portion 63.

In this case, a groove cross-sectional area of the path connection portion 63 is larger than a hole cross-sectional area of each of the cooling air inlet portion 65 and the cooling air outlet portion 67.

In an embodiment of the present disclosure, the cooling pipes 71 are connected to the cooling air inlet portions 65 of the head blocks 61 and disposed in the cooling air flow paths 57 of the core pin assemblies 30.

The cooling pipe 71 is configured to inject the cooling air, which is introduced through the cooling air inlet pipe 69, into the cooling air flow path 57. Therefore, the cooling pipe 71 is disposed in the flow path groove 42 of the plug pin 41 and the hollow portion 52 of the plug bushing 51.

The cooling pipe 71 is coupled to the other side (lower portion based on the drawings) of the cooling air inlet portion 65 through the path connection portion 63. Furthermore, the cooling pipe 71 is coupled to the other side of the cooling air inlet portion 65 by tapping. To this end, the cooling pipe 71 has a coupling end (upper end based on the drawings), and a tapping screw thread 73 is formed at the other side of the cooling air inlet portion 65.

In this case, the cooling air flow path 57 of each of the core pin assemblies 30, in which the cooling pipe 71 is disposed, includes a cooling air discharge flow path 59.

The cooling air discharge flow path 59 is formed between an outer periphery of the cooling pipe 71, an inner periphery of the plug bushing 51, and an inner periphery of the plug pin 41. The inner periphery of the plug bushing 51 may be defined as an inner peripheral surface of the hollow portion 52, and the inner periphery of the plug pin 41 may be defined as an inner peripheral surface of the flow path groove 42.

The cooling air discharge flow path 59 may be connected to the cooling pipe 71, the path connection portion 63, and the cooling air outlet portion 67.

Further, in the embodiment of the present disclosure, the cooling air discharge module 81 may be configured to discharge the cooling air, which flows along the cooling air discharge flow path 59, to the outside through the cooling air outlet portion 67.

The cooling air discharge module 81 is connected to the cooling air outlet portions 67 of the head blocks 61. The cooling air discharge module 81 includes a connection pipe 83, an air discharge housing 85, and an air discharge pipe 87.

The connection pipe 83 is connected to the cooling air outlet portions 67 of the head blocks 61. The air discharge housing 85 is configured to capture the cooling air discharged through the connection pipe 83. The air discharge housing 85 is connected to the connection pipe 83. The air discharge pipe 87 is connected to the air discharge housing 85.

In this case, as illustrated in FIG. 4, the air discharge pipe 87 may extend toward one side edge of the upper holder 21 coupled to the upper die 20. As an example, the air discharge pipe 87 may extend toward one side edge of the upper holder 21 farthest from the operator.

With reference to FIGS. 3-6 and 10, in the embodiment of the present disclosure, the sealing unit 90 is configured to fix the cooling unit 60, which is connected to the core pin assemblies 30, to the upper die 20 and to seal portions between the core pin assemblies 30 and the cooling unit 60.

The sealing unit 90 is coupled to the cooling unit 60 and the upper die 20.

Figure 11:
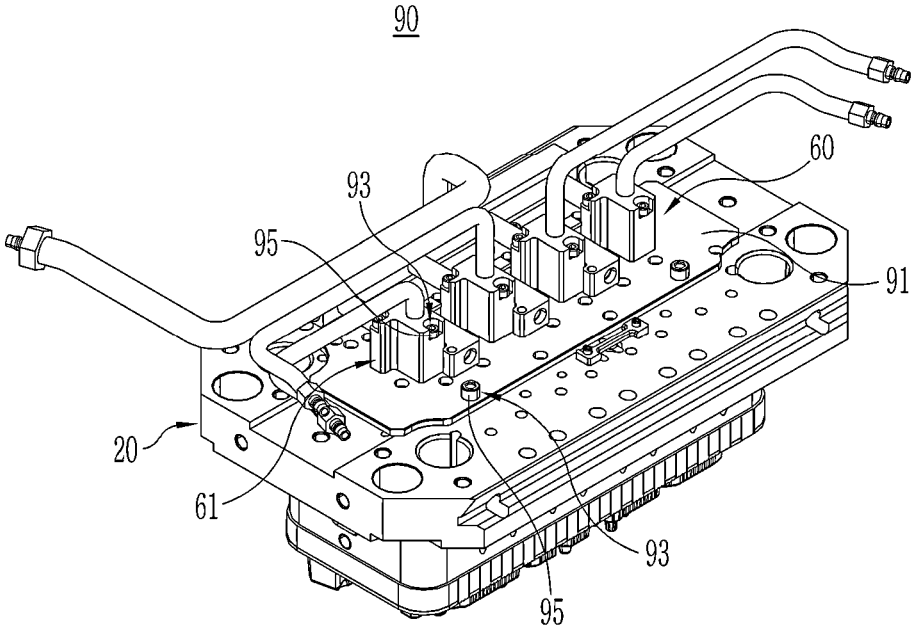
FIGS. 11 and 12 are views illustrating a sealing unit applied to the casting mold device according to the embodiment of the present disclosure.
Figure 12:
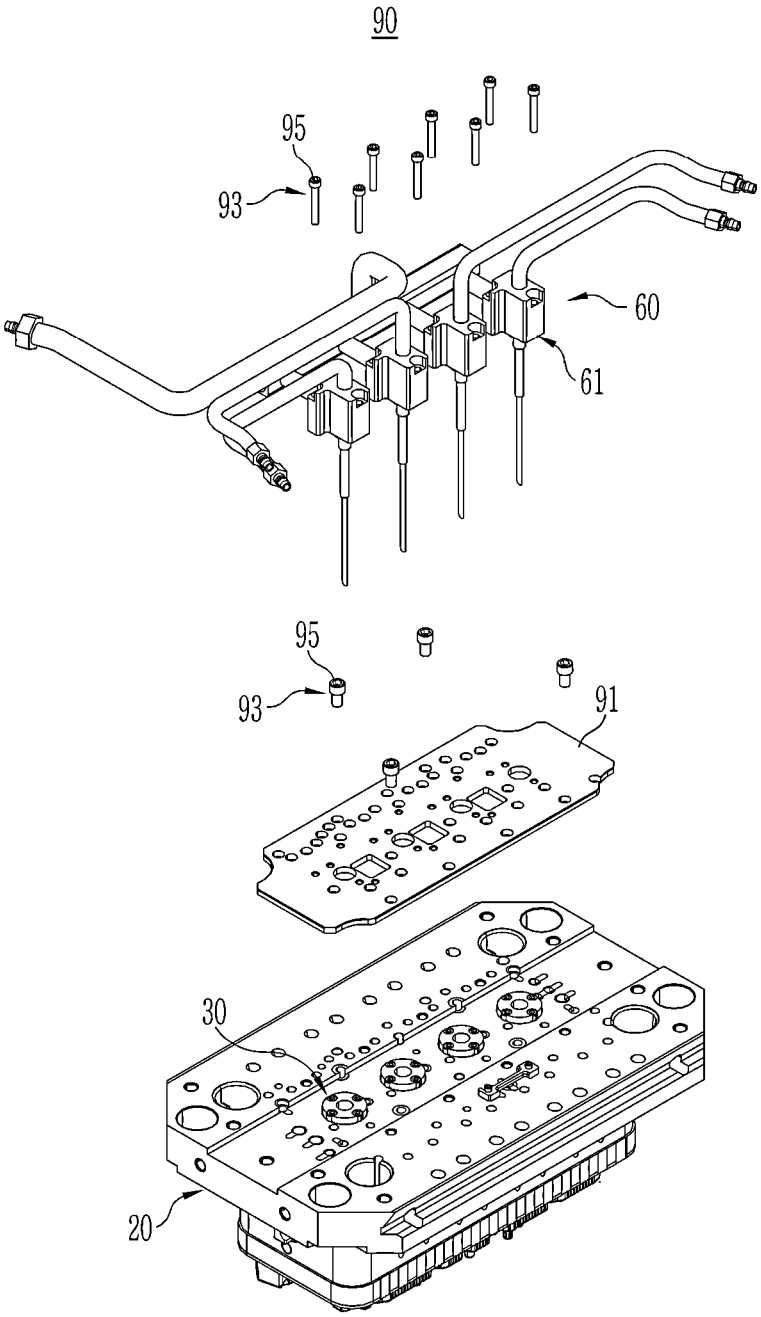

FIGS. 11 and 12 are views illustrating the sealing unit applied to the casting mold device according to the embodiment of the present disclosure.

With reference to FIGS. 11 and 12, the sealing unit 90 according to the embodiment of the present disclosure includes a sealing plate 91 and a plurality of sealing fastening members 93.

The sealing plate 91 is disposed between upper portions of the core pin assemblies 30 and the head blocks 61 of the cooling unit 60.

In this case, lower portions of the head blocks 61 may be supported by an upper surface of the sealing plate 91. Further, as illustrated in FIG. 10, a lower surface of the sealing plate 91 may support the bushing outer flange 53 of the plug bushing 51 fastened to the casing outer flange 33 of the plug casing 31 by means of the plurality of bolts 55.

The plurality of sealing fastening members 93 is configured to fasten the head blocks 61 and the sealing plate 91 and fasten the sealing plate 91 and an upper portion of the upper die 20.

In an embodiment, the sealing fastening members 93 may each include a sealing fastening bolt 95.

Hereinafter, a process of assembling the casting mold device 100 according to the embodiment of the present disclosure configured as described above and an operation of the casting mold device 100 are described in detail with reference to FIGS. 1-13 attached hereto.

Figure 13:
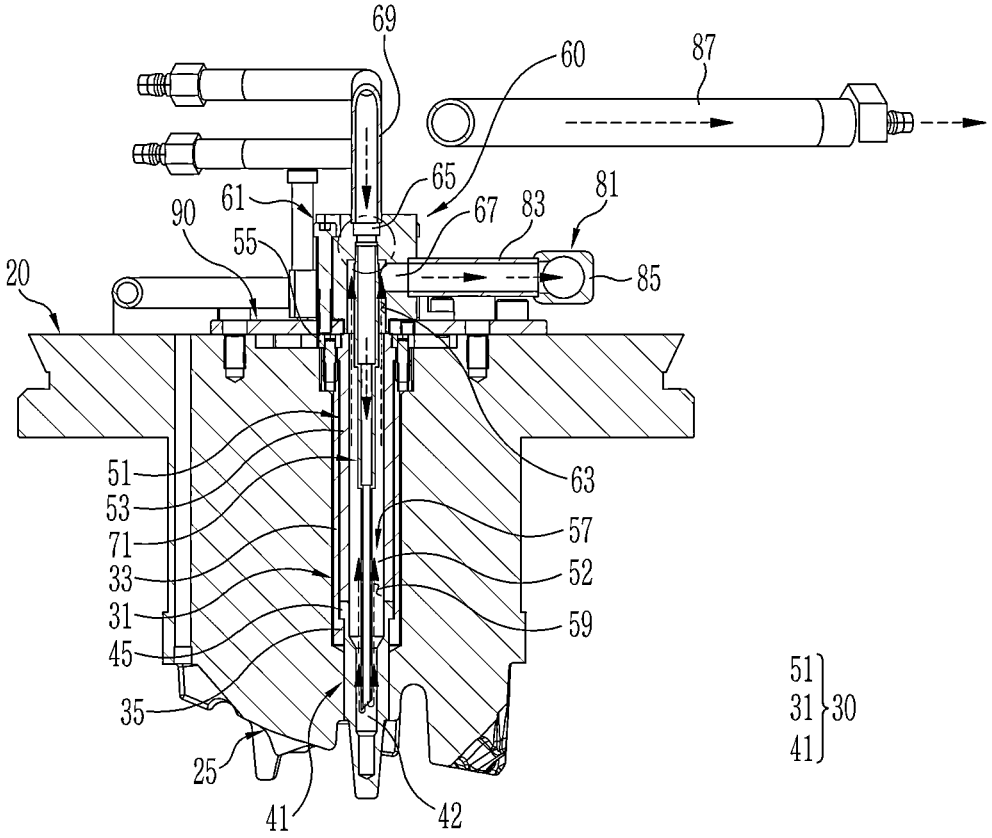
FIG. 13 is a view illustrating an operation of the casting mold device according to an embodiment of the present disclosure.

FIG. 13 is a view illustrating an operation of the casting mold device according to another embodiment of the present disclosure.

With reference to FIGS. 1-12, the plurality of core pin assemblies 30, which each includes the plug casing 31, the plug pin 41, and the plug bushing 51, is provided.

In the state in which the plug casing 31, the plug pin 41, and the plug bushing 51 of each of the core pin assemblies 30 are separated from one another, the plug casing 31, the plug pin 41, and the plug bushing 51 are coupled to one another.

The structure for coupling the plug casing 31, the plug pin 41, and the plug bushing 51 is described below. The plug pin 41 is fitted with the hollow portion 32 of the plug casing 31.

In this case, the plug pin 41 protrudes from the hollow portion 32 of the plug casing 31, and the plug pin 41 is coupled to the casing inner flange 35 of the plug casing 31 by means of the pin outer flange 45 and the locking projection.

Next, the plug bushing 51 is fitted with the hollow portion 32 of the plug casing 31. The plug bushing 51 is disposed in the hollow portion 32 of the plug casing 31 and positioned above the plug pin 41. Further, the bushing outer flange 53 of the plug bushing 51 supports the upper surface of the casing outer flange 33 of the plug casing 31.

In this state, the bushing outer flange 53 and the casing outer flange 33 are fastened by the plurality of bolts 55. Then, the plug pin 41 may be fixed by the plug bushing 51 in the state in which the plug pin 41 is coupled to the casing inner flange 35 by means of the pin outer flange 45 and the locking projection.

As described above, the cooling air flow path 57 is formed in the core pin assembly 30 in which the plug casing 31, the plug pin 41, and the plug bushing 51 are coupled to one another.

Next, the core pin assemblies 30 are fitted with the pin insertion holes 27 of the upper die 20 in the upward/downward direction. In this case, the casing outer flange 33 of the plug casing 31 supports the upper surface of the upper die 20. Further, the plug pins 41 of the core pin assemblies 30 protrude downward from the pin insertion holes 27.

Meanwhile, in the embodiment of the present disclosure, the cooling unit 60, which includes the plurality of head blocks 61, the cooling pipes 71, and the cooling air discharge module 81, is provided.

In an embodiment, the cooling unit 60 may be provided as a modularized component in which the plurality of head blocks 61, the cooling pipes 71, and the cooling air discharge module 81 are connected to one another. In the cooling unit 60, the cooling air discharge module 81 includes the connection pipe 83, the air discharge housing 85, and the air discharge pipe 87.

The cooling pipes 71 are connected to the cooling air inlet portions 65 of the head blocks 61. In addition, the cooling air inlet pipe 69 is connected to the cooling air inlet portion 65.

Further, the connection pipe 83 of the cooling air discharge module 81 is connected to the cooling air outlet portions 67 of the head blocks 61, and the air discharge housing 85 is connected to the connection pipe 83. The air discharge pipe 87 is connected to the air discharge housing 85.

In an embodiment of the present disclosure, the sealing unit 90, which includes the sealing plate 91 and the plurality of sealing fastening members 93, is provided. The plurality of sealing fastening members 93 may include the sealing fastening bolts 95.

As described above, the sealing plate 91 is disposed on the upper portions of the core pin assemblies 30 in the state in which the core pin assemblies 30 are fitted with the pin insertion holes 27 of the upper die 20.

In this case, the lower surface of the sealing plate 91 supports the bushing outer flange 53 of the plug bushing 51 fastened to the casing outer flange 33 of the plug casing 31 by means of the plurality of bolts 55.

The cooling pipe 71 of the cooling unit 60 penetrates a hole formed in the sealing plate 91 and is fitted with the cooling air flow path 57 of each of the core pin assemblies 30. In this case, the cooling pipe 71 is disposed in the flow path groove 42 of the plug pin 41 and the hollow portion 52 of the plug bushing 51 of each of the core pin assemblies 30.

The upper surface of the sealing plate 91 supports the lower portions of the head blocks 61. In this state, the path connection portion 63 of each of the head blocks 61 is connected to the cooling air flow path 57.

The head blocks 61 and the sealing plate 91 are fastened by the sealing fastening bolts 95. Further, the sealing plate 91 and the upper portion of the upper die 20 are fastened by the sealing fastening bolts 95.

The cooling unit 60 may be connected to the core pin assemblies 30 and fixed to the upper die 20. Further, the portions between the core pin assemblies 30 and the cooling unit 60 may be sealed by the sealing plate 91.

Because the cooling unit 60 is coupled to the core pin assemblies 30 as described above, the cooling air discharge flow paths 59 are formed in the cooling air flow paths 57 of the core pin assemblies 30 in which the cooling pipes 71 are disposed.

The cooling air discharge flow path 59 is formed between the outer periphery of the cooling pipe 71, the inner periphery of the plug bushing 51, and the inner periphery of the plug pin 41. Further, the cooling air discharge flow path 59 is connected to the cooling pipe 71, the path connection portion 63, and the cooling air outlet portion 67.

Hereinafter, an operation of the casting mold device 100, in which the core pin assemblies 30 are mounted in the upper die 20 as described above, is described with reference to FIG. 13. First, the upper die 20 is moved upward by the drive device, such that the upper die 20 is in a state of being detached from the lower die 10.

In this state, when the upper die 20 is moved downward by the drive device and attached to the lower die 10, the cavity 7 with a preset shape and volume is formed between the lower forming part 15 of the lower die 10 and the upper forming part 25 of the upper die 20.

Next, the molten metal 5 accommodated in the heat retention furnace 17 is pushed upward along a preset route by low-pressure compressed air from below the lower die 10. Then, the molten metal 5 is injected into the cavity 7 through the molten metal injection part 13 of the lower die 10.

Therefore, the casting mold device 100 according to the embodiment of the present disclosure may produce the cylinder head 1 with a preset shape by solidifying the molten metal 5 injected into the cavity 7.

In this case, the core pin assemblies 30 may form the spark plug mounting portions 3 in the form of holes in the cylinder head 1 in the state in which the core pin assemblies 30 are disposed in the upper forming part 25 of the upper die 20.

As described above, in the embodiment of the present disclosure, during the process of producing the cylinder head 1, the cooling air is supplied to the cooling air inlet pipes 69 and introduced into the cooling air inlet portions 65 of the head blocks 61.

The cooling air is introduced into the cooling air flow paths 57 of the core pin assemblies 30 through the cooling pipes 71. In this case, the cooling air introduced into the cooling air flow path 57 flows along the cooling air discharge flow path 59 in the flow path groove 42 of the plug pin 41.

The cooling air, which flows along the cooling air discharge flow paths 59 as described above, passes through the path connection portions 63 of the head blocks 61 and is discharged through the cooling air outlet portions 67.

In this case, because the portions between the core pin assemblies and the cooling unit 60 are sealed by the sealing unit 90, the cooling air introduced into the cooling air flow paths 57 may be discharged through the cooling air outlet portions 67 without leaking between the core pin assemblies 30 and the cooling unit 60.

Therefore, the casting mold device 100 according to the embodiment of the present disclosure may cool the core pin assemblies 30 while allowing the cooling air to flow to the cooling air flow paths 57 of the core pin assemblies 30.

Meanwhile, the cooling air, which is discharged through the cooling air outlet portions 67 of the head blocks 61, is captured in the air discharge housing 85 through the connection pipe 83. The cooling air, which is captured in the air discharge housing 85 as described above, is discharged to the outside through the air discharge pipe 87.

In this case, the air discharge pipe 87 discharges the cooling air at one side edge of the upper holder 21 farthest from the operator.

The casting mold device 100 according to the embodiment of the present disclosure described above applies the separate cooling air discharge structure, which discharges the cooling air to the outside, to the cooling unit 60 configured to cool the core pin assemblies 30 by using the cooling air.

Further, the casting mold device 100 according to the embodiment of the present disclosure adopts the sealing structure configured to seal the cooling air that may leak between the core pin assemblies 30 and the cooling unit 60.

Therefore, the casting mold device 100 according to the embodiment of the present disclosure may minimize exhaust noise of the cooling air caused when the core pin assemblies 30 are cooled by the cooling air.

In particular, the casting mold device 100 according to the embodiment of the present disclosure may discharge the cooling air through the cooling air discharge module 81 at one side edge of the upper holder 21 farthest from the operator.

Therefore, the casting mold device 100 according to the embodiment of the present disclosure may improve the working environment of the operator while preventing hearing impairment of the operator caused by exhaust noise of the cooling air.

Furthermore, according to the casting mold device 100 according to the embodiment of the present disclosure, the plug casing 31, the plug pin 41, and the plug bushing 51 of each of the core pin assemblies 30 are structured to be separated from or coupled to one another.

Therefore, according to the casting mold device 100 according to the embodiment of the present disclosure, when the core pin assemblies 30 are damaged because the core pin assemblies 30 are in contact with the high-temperature molten metal 5 over a long period of time, only some damaged parts may be replaced, which may reduce costs required to replace the core pin assemblies 30.

While the embodiments of the present disclosure have been described above, the present disclosure is not limited thereto, and various modifications can be made and carried out within the scope of the claims, the detailed description of the present disclosure, and the accompanying drawings, and also fall within the scope of the present disclosure.

<Description of symbols>

| | |
|---|---|
| 1: Cylinder head | 3: Spark plug mounting portion |
| 5: Molten metal | 7: Cavity |
| 10: Lower die | |
| 11: Lower holder | 13: Molten metal injection part |
| 15: Lower forming part | 17: Heat retention furnace |
| 20: Upper die | 21: Upper holder |
| 25: Upper forming part | 27: Pin insertion hole |
| 30: Core pin assembly | 30a: Separating pins |
| 31: Plug casing | 32, 52: Hollow portion |
| 33: Casing outer flange | 35: Casing inner flange |
| 41: Plug pin | 42: Flow path groove |
| 45: Pin outer flange | 51: Plug bushing |
| 53: Bushing outer flange | 55: Bolt |
| 57: Cooling air flow path | 59: Cooling air discharge flow path |
| 60: Cooling unit | 61: Head block |
| 63: Path connection portion | 65: Cooling air inlet portion |
| 67: Cooling air outlet portion | 69: Cooling air inlet pipe |
| 71: Cooling pipe | 73: Tapping screw thread |
| 81: Cooling air discharge module | 83: Connection pipe |
| 85: Air discharge housing | 87: Air discharge pipe |
| 90: Sealing unit | 91: Sealing plate |
| 93: Sealing fastening member | 95: Sealing fastening bolt |
| 100: Casting mold device | |

What is claimed is:

1. A casting mold device comprising:

a lower die;

an upper die configured to attach to or detach from the lower die;

a plurality of core pin assemblies mounted in the upper die and including a plurality of separating pins capable configured to couple to or separate from one another, wherein the plurality of core pin assemblies includes cooling air flow paths formed in the plurality of separating pins coupled to one another;

a cooling unit installed on the upper die and connected to the cooling air flow paths so as to inject and discharge cooling air; and a sealing unit coupled to the cooling unit and the upper die to seal portions between the core pin assemblies and the cooling unit, wherein the plurality of separating pins each comprise:

a cylindrical plug casing fitted with a pin insertion hole formed in the upper die in an upward/downward direction, the cylindrical plug casing being opened at upper and lower ends thereof;

a plug pin fitted with the cylindrical plug casing, coupled to a lower portion of the cylindrical plug casing, opened at an upper end thereof, and closed at a lower end thereof; and a plug bushing fitted with the cylindrical plug casing so as to be positioned above the plug pin, coupled to an upper portion of the cylindrical plug casing, and having a cylindrical shape opened at upper and lower ends thereof.

2. The casting mold device of claim 1, wherein the core pin assemblies are respectively mounted in the pin insertion holes formed in the upper die in the upward/downward direction to form spark plug mounting portions of a cylinder head.

3. The casting mold device of claim 1, wherein the cooling unit comprises:

a plurality of head blocks disposed at positions corresponding to the core pin assemblies and respectively having cooling air inlet portions and cooling air outlet portions;

cooling pipes connected to the cooling air inlet portions of the plurality of head blocks and disposed in the cooling air flow paths; and a cooling air discharge module connected to the cooling air outlet portions of the plurality of head blocks.

4. The casting mold device of claim 3, wherein the cooling unit comprises cooling air inlet pipes each connected to one side of each of the cooling air inlet portions of the plurality of head blocks, and the cooling pipes are each connected to another side of each of the cooling air inlet portions by tapping.

5. The casting mold device of claim 3, wherein the cooling air discharge module comprises:

a connection pipe connected to the cooling air outlet portions of the plurality of head blocks;

an air discharge housing connected to the connection pipe; and an air discharge pipe connected to the air discharge housing.

6. The casting mold device of claim 5, wherein the air discharge pipe extends toward one side edge of an upper holder coupled to the upper die.

7. The casting mold device of claim 3, wherein the sealing unit comprises:

a sealing plate disposed between the core pin assemblies and the plurality of head blocks; and a plurality of sealing fastening members configured to fasten the plurality of head blocks and the sealing plate and fasten the sealing plate and the upper die.

8. The casting mold device of claim 7, wherein the sealing fastening members respectively include sealing fastening bolts.

9. The casting mold device of claim 1, wherein:

the cylindrical plug casing comprises a casing outer flange formed on an outer periphery of an upper end thereof, and a casing inner flange formed on an inner periphery of a lower end thereof, and the plug bushing comprises a bushing outer flange formed on an outer periphery of an upper end thereof.

10. The casting mold device of claim 9, wherein the casing outer flange and the bushing outer flange are fastened by a plurality of bolts.

11. The casting mold device of claim 9, wherein the casing inner flange is coupled to a pin outer flange formed at an upper end of the plug pin by a locking projection.

12. The casting mold device of claim 1, wherein the cooling air flow paths comprise a flow path groove formed in the plug pin, and a hollow portion of the plug bushing connected to the flow path groove.

13. The casting mold device of claim 1, wherein the cooling unit comprises:

a plurality of head blocks disposed at positions respectively corresponding to the core pin assemblies and respectively having cooling air inlet portions and cooling air outlet portions; and cooling pipes connected to the cooling air inlet portions of the plurality of head blocks and disposed in the plug bushing and the plug pin.

14. The casting mold device of claim 13, wherein the cooling air flow paths comprise:

a cooling air discharge flow path formed between an outer periphery of a cooling pipe of the cooling pipes, an inner periphery of the plug bushing, and an inner periphery of the plug pin, wherein the cooling air discharge flow path is connected to the cooling pipe and a cooling air outlet portion of the cooling air outlet portions.

* * * * *